US009694603B1

(12) United States Patent
Jariabka et al.

(10) Patent No.: US 9,694,603 B1
(45) Date of Patent: Jul. 4, 2017

(54) MEDIA GUIDES WITH PROTRUSIONS

(71) Applicant: HEWLETT-PACKARD DEVELOPMENT COMPANY, L.P., Houston, TX (US)

(72) Inventors: Keith Jariabka, Portland, OR (US); Alvin Post, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/053,672

(22) Filed: Feb. 25, 2016

(51) Int. Cl.
*B41J 2/15* (2006.01)
*B41J 11/00* (2006.01)

(52) U.S. Cl.
CPC ..... *B41J 11/0045* (2013.01)

(58) Field of Classification Search
CPC ..... B41J 13/0009; B41J 11/46; B41J 11/007; B41J 11/42; B41J 2/01; B41J 11/0005; B41J 11/003; B41J 11/0045; B41J 11/04; B41J 13/02; B41J 13/03
See application file for complete search history.

(56) References Cited

U.S. PATENT DOCUMENTS

| | | | | |
|---|---|---|---|---|
| 6,536,968 | B2 | 3/2003 | Lee et al. | |
| 6,990,902 | B2 | 1/2006 | Kelm et al. | |
| 7,588,319 | B2 * | 9/2009 | Silverbrook | B41J 2/14427 347/101 |
| 9,028,034 | B2 * | 5/2015 | Horaguchi | B41J 11/007 347/104 |

FOREIGN PATENT DOCUMENTS

| | | |
|---|---|---|
| CN | 102616008 | 8/2012 |
| JP | 2000053297 | 2/2000 |
| JP | 2000338795 | 12/2000 |
| JP | 2007240843 | 9/2007 |
| JP | 2009292590 | 12/2009 |

* cited by examiner

*Primary Examiner* — Lamson Nguyen
(74) *Attorney, Agent, or Firm* — HP Inc. Patent Department

(57) ABSTRACT

An example support structure assembly is described as including a brace, a media guide, and a compression member. An example brace includes a structure defining a mount area on a first surface of the brace and a first protrusion extending from a second surface of the brace. An example media guide includes a blade member, a hinge member, and a second protrusion extending away from the hinge member. An example compression member is coupled to the first protrusion of the brace and the second protrusion of the media guide to place a force on the media guide where a vector defines the force with a first component magnitude in a first direction towards the mount area that is greater than a second component magnitude in a second direction away from the mount area.

10 Claims, 4 Drawing Sheets

MEDIA GUIDES WITH PROTRUSIONS

BACKGROUND

An imaging device generally includes a structure defining a media path where media is located within the imaging device, to perform operations related to imaging process. For example, a printer device may pick media from a stack of paper and pull the paper through a paper path to a print zone to receive print fluid, such as ink or toner, and the printed-on media is then placed on an output stack tray. A media path may generally include media guides to assist proper movement and orientation of the media through the media path.

DETAILED DESCRIPTION

In the following description and figures, some example implementations of support structure assemblies, media guides, and/or imaging devices are described. The terms "include," "have," and variations thereof, as used herein, mean the same as the term "comprise" or appropriate variation thereof.

In examples described herein, an "imaging device" may be a printing device to print content on a physical medium (e.g., paper or a layer of powder-based, build material, etc.) with a printing fluid (e.g., ink) or toner. In the case of printing on a layer of powder-based build material, the printing device may utilize the deposition of printing fluids in a layer-wise additive manufacturing process. An example of printing fluid is ink ejectable from a printhead on a carriage of the printing device. A printing device may utilize suitable printing consumables, such as ink, toner, fluids or powders, or other raw materials for printing. In some examples, a printing device may be a three-dimensional (3D) printing device.

Media guides are generally implemented with some adjustability to allow media to pass through a media path of the imaging device as well as guide the media to a particular direction or orientation in the media path. Compression members, such as springs, may be used to generate a force on a media guide that is adjustable and assists the media. For example, a compression member may be vertically affixed to the structure of the imaging device to provide vertical force on the media to keep the media in an acceptable horizontal position. Compression members may take up a substantial amount of vertical space in the imaging device and may utilize a relative space in the paper path to position the media guides. This may be contrary to a desirable goal of reducing the vertical footprint of imaging devices.

Various examples described below relate to implementing a protrusion on the media guide to allow a compression member to fit substantially horizontally to support the media guide rather than positioned substantially vertically. By adapting the media guide to receive force from the compression member where the majority of the magnitude is horizontal (or towards the axis of rotation of the media guide), a more compact media guide and/or structural support assembly is possible, for example.

Figure 1A:
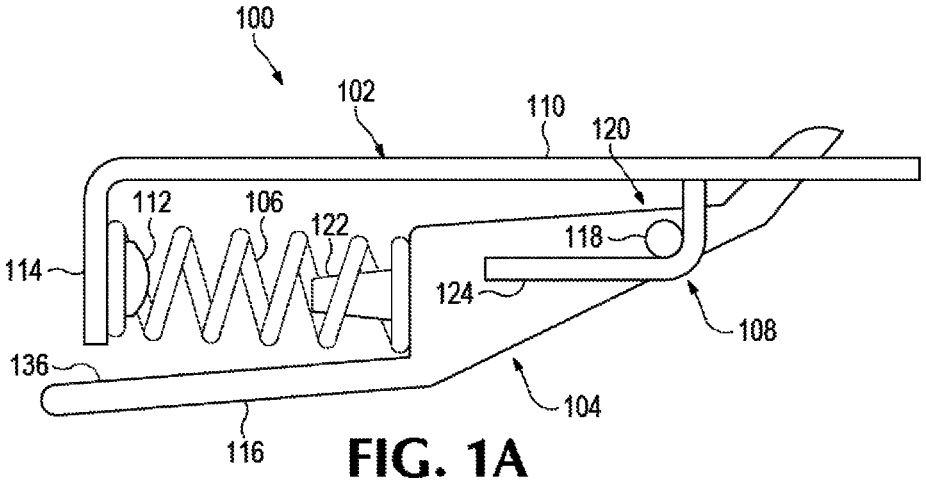
FIG. 1A is a side view of an example support structure assembly.

FIG. 1A is a side view of an example support structure assembly 100. In general, the example support structure 100 includes a brace 102, a media guide 104, and a compression member 106 and the compression member 106 provides force on the media guide 104 (e.g., and opposed to the brace 102) to generate rotation of the media guide 104 about a hinge axis.

The brace 102 is a structural member of the support structure assembly 100. For example, the brace 102 may be a cross brace that fits across the paper path of an imaging device to define a section of the ceiling of the path. The brace 102 may be rigidly attached to the chassis of an imaging device. For example, the brace 102 may be a support structure to hold up a media guide 104. The brace 102 may be made of supportive material, such as metal or plastic.

The brace 102 may include a structure that defines a mount area that interfaces with the media guide 104. For example, a surface 110 of the brace 102 may form an opening to receive a portion 118 of the media guide 104. The brace 102 depicted in FIG. 1A may have two major surfaces, such as a first surface 110 where the media guides are rotatably mounted at the mount area and a second surface 114 that runs substantially perpendicular to the first surface 110. The second surface 114 includes a protrusion 112, such as a boss for mounting. The protrusion 112 extends from the surface 114 to allow for a compression member 106 to couple to the brace 102. The brace 102 may include other features (such as walls or other structures that form openings or obstructions) that facilitate stability, orientation, and generally keeping the media guide 104 rotating in place properly. For example, the brace 102 comprises a portion (depicted as surface 124 in FIG. 1A) as a tabular protrusion extending from the mount area for insertion of a hinge feature 120 of the media guide 104, where the surface 124 is substantially parallel to surface 110 and substantially perpendicular to surface 114. For another example, the pivoting hinge may be realized by molding a plastic groove in the media guide to hook in an opening in the brace surface 110. Other example features are depicted on the surface 110 of the brace 102 of FIG. 3.

The media guide 104 generally includes a blade member 116, a hinge member 120, and a protrusion 122. The media guide may be made of a single material with blade, hinge, and protrusion features integrated or may be made of multiple materials and/or structures. For example, the media guide 104 of FIGS. 4A and 4B may be made of single, integrated piece of plastic. The blade member 116 is a surface facing towards the media that performs guidance of the media. In this fashion, the blade member 116 may be substantially flat to not obstruct forward movement of the media along the media path and direct the media to the proper position in the media path. For another example, the blade member 116 may have a plurality of surfaces with different slopes or a surface describing a curve where the surfaces may be smooth or otherwise facilitate guidance of media through the paper path. The blade member 116 may include features to facilitate orientation of the media guide 104. For example, a surface 136 opposite the media facing surface of blade member 116 may include a feature that limits rotation of hinge member 120 of the media, guide 104 in a particular direction, such as when the surface 136 is in contact with a surface of the brace 102, such as surface 114.

The hinge member 120 may include a first portion 118 that corresponds to the mount area on the brace 102. For example, the first portion 118 may fit between the surface 124 and surface 110 and may fit in a hinge feature of the mount area 108 to allow for the media guide 104 to rotate about the axis of a hinge formed by mating the hinge member 120 and the structure 108 forming the mount area. The hinge member 120 may include a second portion that guides or otherwise limits rotation of the hinge member, such as portion 126 shown in FIGS. 4A and 4B that extends substantially towards the protrusion 122 of the media guide 104.

Figure 1B:
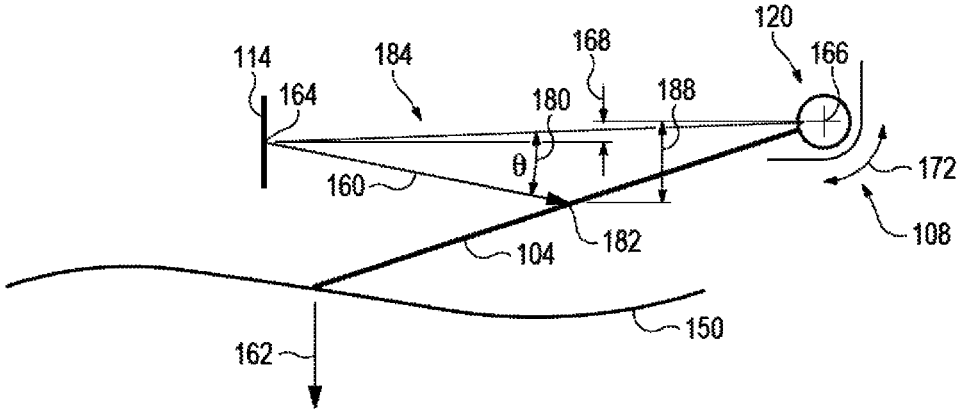
FIG. 1B is an example depiction of example forces and example positions of components of an example support structure assembly.

FIG. 1B is an example depiction of example forces and example positions of components of an example support structure assembly 100. With reference to FIGS. 1A and 1B, the protrusion 122 extends away from the hinge member 120 to allow a compression member 106 to induce a force 160 on the media guide. For example, the protrusion 122 may extend in a substantially perpendicular direction to an axis 166 of rotation of the hinge member 120.

The compression member 106 may extend between the protrusion 112 of the brace 102 and the protrusion 122 of the media guide 104. The compression member 106 is depicted as a spring in FIG. 1A with a diameter of the spring to fit around the protrusions 112 and 122. Other example spring compression members ray be selected from an example group including a compression spring, a leaf spring, and/or a torsion spring. Other compression members may include a solid or hollow column made of plastic or rubber for example.

Figure 5:
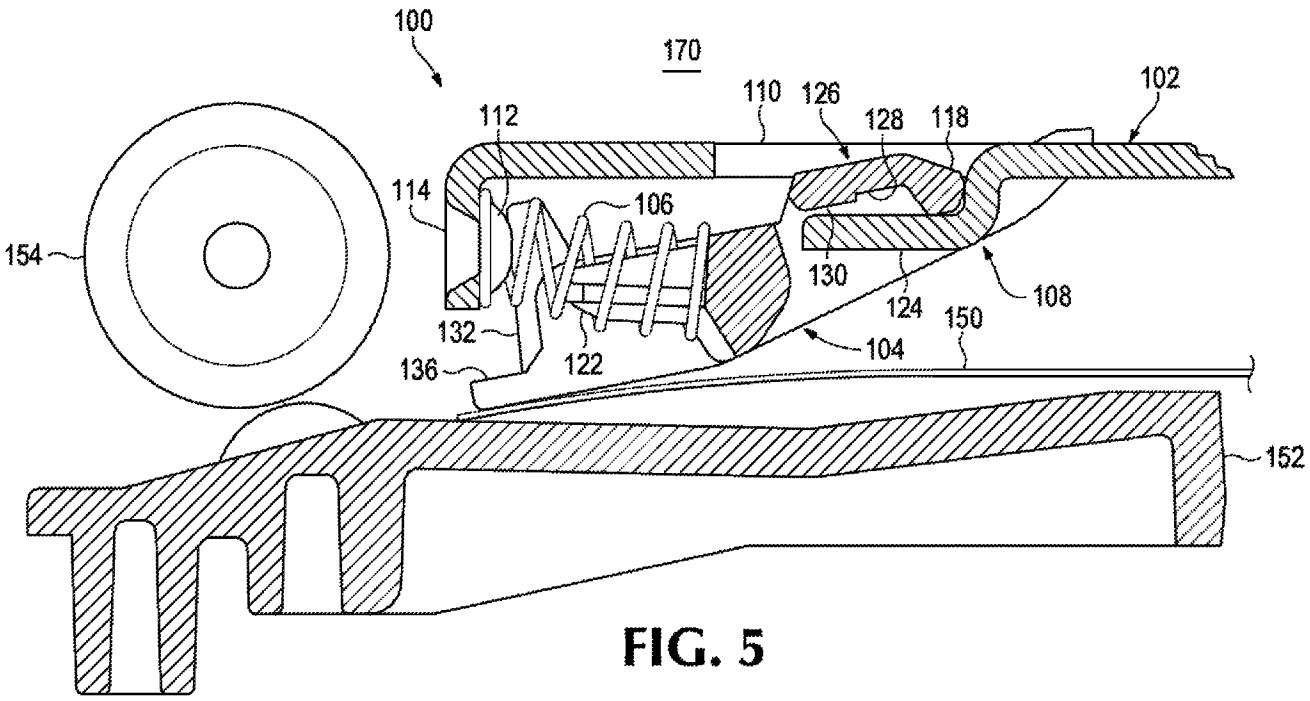
FIG. 5 is a cross-sectional view of an example imaging device.

The compression member 106 is coupled to the brace 102 and the media guide 104 to always have a moment about a pivot point (e.g., the axis of rotation 166). The compression member 106 may be coupled to the protrusion 112 of the brace 102 and the protrusion 122 of the media guide 104 to place force on the media guide 104 where the center point 164 of the protrusion 112 may be horizontally offset from the axis 166 of rotation of the hinge member 120 by a distance 168. The distance 168 is large enough to ensure the compression member applies a force away from the brace 102 and small enough so that the force component perpendicular to the media feed direction (e.g., the vertical force component) is smaller than the force component parallel to the media feed direction (e.g., the horizontal force component towards the hinge member). The force 160 may push from the brace 102 to the media guide 104 to generate rotation 172 about the hinge defined by the hinge member 120 and mount area structure 108. The force 160 is definable by a vector having a first component magnitude in a first direction towards the mount area structure 108 that is greater than a second component magnitude in a second direction away from the mount area structure 108. In other words, an orientation of the force 160 being offset from the axis 166 generates a component magnitude 162 that pushes towards the media 150, where that component magnitude 162 towards the media is smaller than the complimentary component magnitude to define the force 160. In the example of FIG. 5, the compression member 106 provides force on the media guide 104 to maintain the second portion 126 of the hinge member 120 in contact with the first portion 124 of the brace 102 until another further force is applied by media contacting the media guide (e.g., the media 105 passing through the print path between the upper media guide 104 and the lower media guide 152 of FIG. 5).

The force 160 applies to a point 182 on the media guide 104 that is offset from the axis 166 to induce the rotation of the media guide to a position that is pushed away from the brace 102. The distance between the axis 166 and the point 182 of the force on the media guide 104 (e.g., where the compression member 106 couples to the media guide 104) is depicted as distance 188. An angle 180 is defined between the point 182 where the compression member acts on the media guide 104, the point 164 where the compression member acts on the brace 102, and the axis 166 of rotation of the media guide 104. The angle 180 is acute to generate the force on the media guide 104 and this may allow the point 164 of the compression member to the brace 102 to be different positions and enable the compression member to fit substantially horizontally between the brace and the media guide. For example, in other implementations, the point 164 may be at the same horizontal plane or higher than the axis 166. The angle 180 may be any acute angle. For example, the angle 180 may not exceed 45 degrees, may be less than 30 degrees, may be less than 20 degrees, may be less than 15 degrees, may be less than 10 degrees, or may be less than 5 degrees. The angle 180 is greater than zero.

The media guide 104 may have a range of rotation 72 defined between a first contact orientation with the brace (such as when surface 166 of the media guide 104 is in contact with surface 114 of the brace 102) and a second contact orientation (such as when surface 136 of portion 126 of the media guide 104 contacts the surface 124 of the brace 102). Example ranges of rotation 172 may include less than 45 degrees, less than 30 degrees, less than 20 degrees, less than 15 degrees less than 10 degrees.

Figures 2, 3:
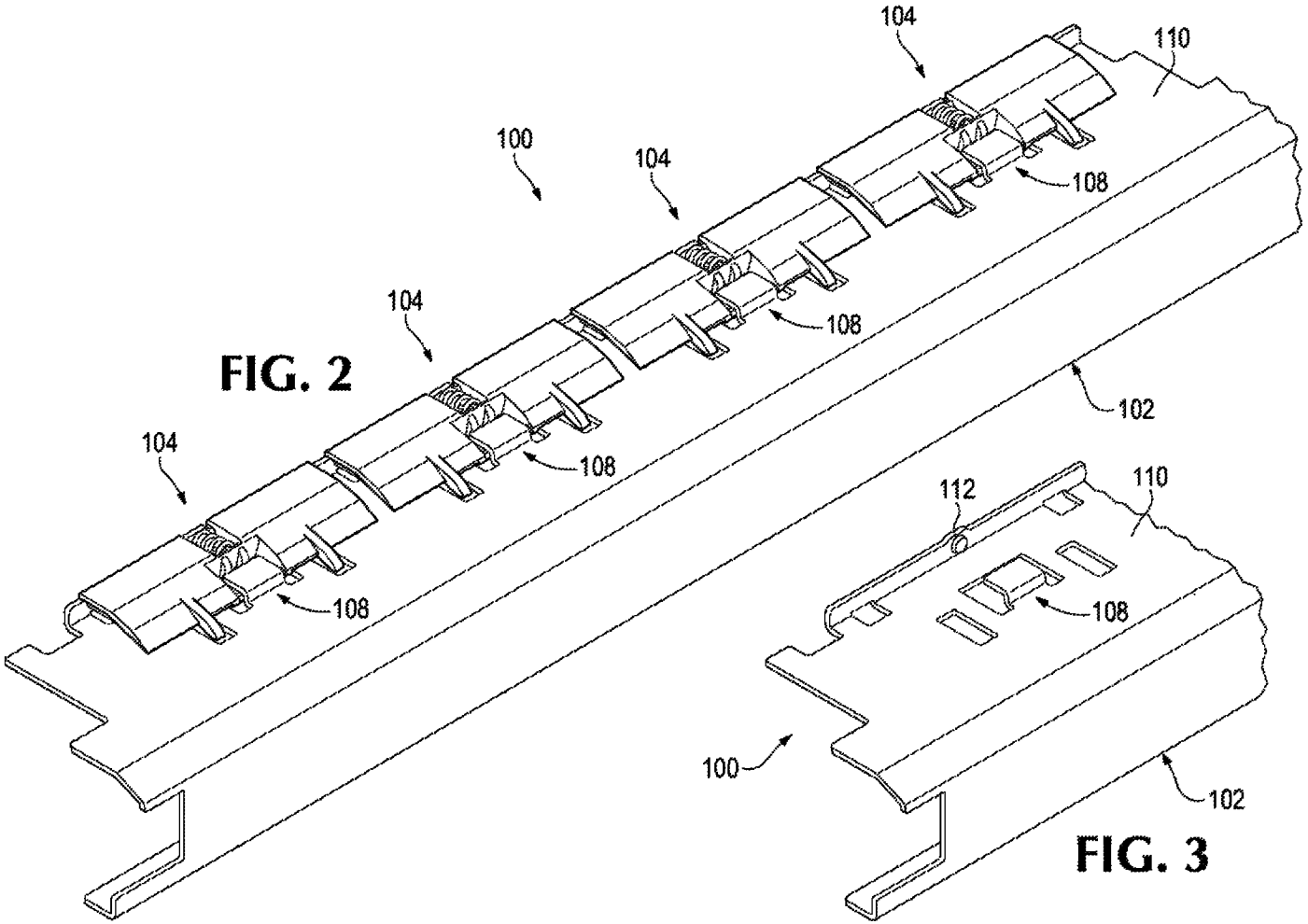
FIG. 2 is a perspective view of an example support structure assembly with a plurality of example media guides.
FIG. 3 is a perspective view of an example section of an example brace of an example support structure assembly.

FIG. 2 is a perspective view of an example support structure assembly 100 with a plurality of example media guides 104, and FIG. 3 is a perspective view of an example section of an example brace 102 of an example support structure assembly 100. Referring to FIG. 2, the brace 102 includes a plurality of media guides 104 mounted in a plurality of mount areas defined by structures 108 of the brace 102. For example with reference to FIG. 3, the surface 110 of the brace 102 may be defined with features 108 that form a plurality of guide mount interfaces on the surface 110 where the plurality of guide mount interfaces are compatible with the hinge members of the plurality of media guides 104. FIG. 2 depicts four media guides 104, however, any number of media guides 104 and/or size of media guides may be used in accordance with the description herein. For example, the four media guides may be replaced with a single, longer media guide and a number of springs coupled between the single media guide and the brace 102. The brace 102 may include a plurality of hemispherical protrusions, such as hemispherical protrusion 112 of FIG. 3, that are formed on a surface 114 of the brace 102 that is distinct from the surface 110 (e.g., surface 114 is substantially perpendicular to the surface 110). The plurality of hemispherical protrusions may be shaped to forma fitted coupling with an end of the compression members for each media guide 104.

Figure 4A:
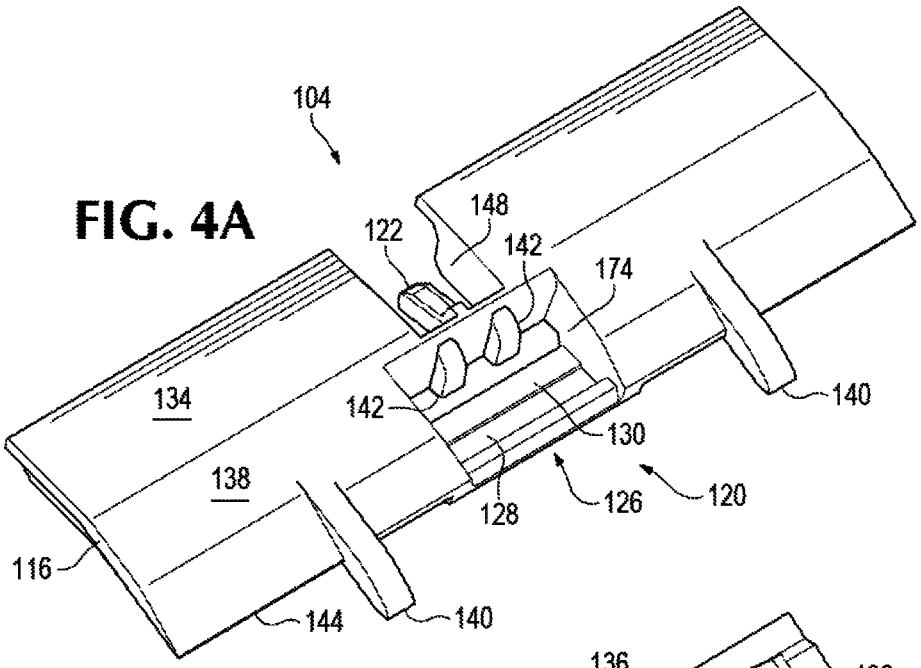
FIGS. 4A and 4B are perspective views of an example media guide.
Figure 4B:
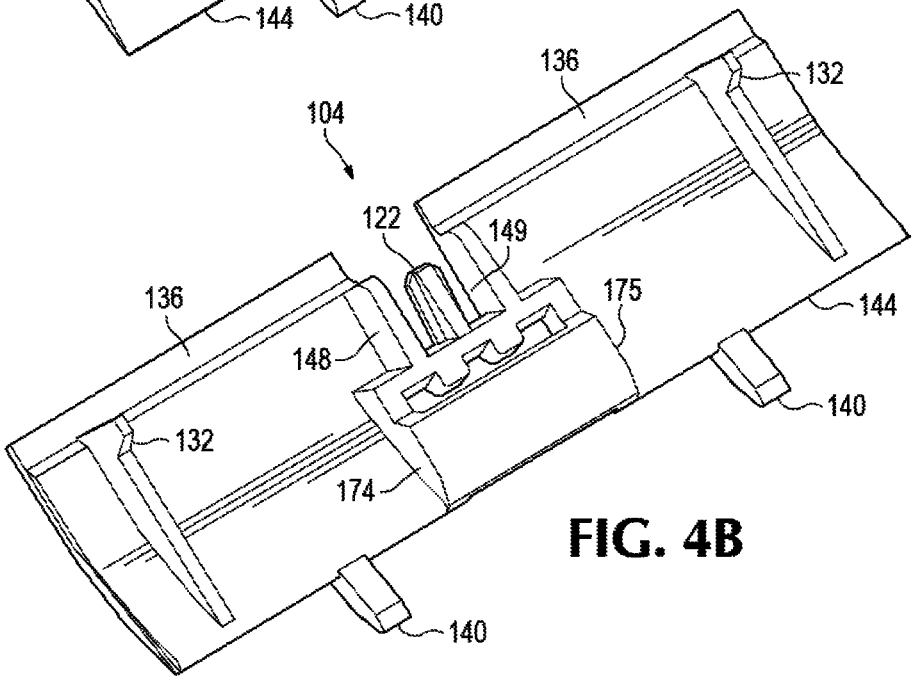

FIGS. 4A and 4B are perspective views of an example media guide 104. FIG. 4A shows a first side of the media guide that is to face away from the brace and to face towards the media as the media passes through the media path in a printer while FIG. 4B shows a second side of the media guide 104 that is to face towards the brace.

Referring to FIG. 4A, the media guide 104 generally includes a blade member 116, a hinge member 120, and a protrusion 122. The blade member includes a surface that forms a cavity (e.g., a surface that defines the boundaries of the cavity) at a first end of the blade member with a size compatible with a compression, member (e.g., a cavity size about the length of a spring when compressed). The media guide 104 of FIGS. 4A and 4B depicts a structure formed by walls 148 and 149 that define a cavity within the blade member (e.g. cut out of the substantially flat surface 134) and a compression mount interface (e.g., protrusion 122) within the cavity. By removing a part of the blade member and structuring the protrusion 122 to not extend beyond the surface 134, the compression member may be compactly fit onto the media guide 104. The protrusion 122 may include structural features to assist coupling of the compression member 106 to the media guide 104.

The blade member 116 of media guide 104 as shown in FIG. 4A depicts a plurality of surfaces that are substantially flat, including surfaces 134 and 138. The plurality of surfaces have different slopes. For example, the surface 134 is coupled to the surface 138 and has a different slope in comparison to the surface 138. The various slopes on the plurality of flat surfaces may assist to guide media, in particular to allow multiple types of media to pass through the media path and be guided by the plurality of substantially flat surfaces of the media guide 104. For example, the profile of the blade member 116 may be chosen according to design of the media path, such as using in a single flat surfaces, multiple surfaces, a curved surface, etc.

The media guide 104 includes a hinge feature 120 coupled to the blade member 110. The hinge feature 120 includes a mount structure 126, a hinge line 144, a rotational obstruction feature 130, and a lateral obstruction feature defined by walls 174 and 175. The mount structure 126 defines a recess capable of receiving a guide mount interface member of a structural support assembly, such as a tab, and, in the example of 4A, includes the was 174 and 175 on opposing sides of the mount structure to hinder lateral movement of the blade member 116. The hinge line 144 represents the axis of rotation of the media guide 104 and is across the blade member.

The hinge feature 120 of FIGS. 4A and 4B is on an opposing end of the blade member 116 than the cavity for the protrusion 122. The media guide 104 of FIGS. 4A and 4B depicts a structure formed of walls 174 and 175 that define a hinge member 120 for rotation as well as a portion 126 to limit rotation. The recess formed by walls 174 and 175 may allow for insertion into the mount area interface of the brace 102. A mount feature 126 is coupled to the hinge 120 to define the range of rotation of the media guide (e.g., limit range of rotation in a particular direction). The mount feature 126 may include an indented surface 128 capable of receiving a portion of the brace 102 and securely mount the media guide 104. In another example, the rotation stop could be designed to work on the other side of the media guide 104. The mount feature 126 may include a catch 130 on an end of the mount feature portion of the media guide to contact a portion (such as a tab of the brace 102) when the media guide 104 is in a first orientation associated with a maximum rotation of the media guide when coupled to the brace with the compression member. In another example, the mount feature may have a curved structure with a first end coupled to the hinge and a second end to contact a second mount feature on a guide mount interface to hinder rotational movement of the media guide.

The rotation of the media guide 104 may be limited by a surface 136 and/or other protrusions, such as legs 132. The legs 132 extend from the blade member to provide orientation of the media guide, such as during rotation. The legs 132 may contact a surface of the brace 102, such as surface 114, or may otherwise correspond with the surfaces of the brace 102 to ensure the media guide has limited lateral movement or other non-rotational movement.

The media guide may include features to assist proper guidance of the media. For example, the media guide 104 of FIGS. 4A and 4B depict a first plurality of skis 140 and a second plurality of skis 142. The skis 140 may assist media if it is curling upwards, for example, by coupling the skis to an end of the blade member. The skis 142 may correspond to the hinge member (e.g., the recess formed by walls 174 and 175) to assist an edge of media from being caught within the recess feature of the media guide 104.

Referring to the examples of FIGS. 4A and 4B, the protrusion feature 122 extends within the cavity of the blade member 116 and away from the hinge line 144 in a substantially perpendicular direction of the hinge line 144. The protrusion feature 122 is offset from the hinge line 144 as depicted in FIGS. 1A and 5 to be away from the hinge a degree that the affects the amount of rotational force applied on the media guide 104.

FIG. 5 is a cross-sectional view of an example imaging device 170. A portion of the media path of the imaging device 170 is depicted in FIG. 5 showing a brace 102, an upper media guide 104, a lower media guide 152, a compression member 106, and a feed shaft 154 and media 150 passing along the portion of the paper path defined between the upper media guide 104 and the lower media guide 152.

The compression member 106 is oriented in a position substantially parallel to the surface 110 of the brace 102 when the surface 136 is in contact with the brace 102 (e.g., at surface 114) to limit rotation of the hinge member. When in that orientation, the compression member 106 is may also be substantially parallel to the paper feed direction and surface of the media 150. The upper media guide 104 rotates to change the vertical space between the upper media guide 104 and the lower media guide 152. The movement of the media guides changes the space of the media path perpendicular to the media feed direction.

The imaging device 170 may include a plurality of upper media guides rotatable mounted to the brace 102 of the structural support assembly 100 and operably coupled to the brace 102 by a plurality of compression members (e.g., in contact with the plurality of compression members by the protrusion 122 or otherwise applying force on the structure of the cavity of the blade member). For example the upper media guides may be positionable based on the compression member 106 in a plurality of positions that are substantially parallel to the media path and/or paper surface based on the allowed rotation of the upper media guides. The protrusion 122 of the media guide 104 may face substantially perpendicular direction to the axis of rotation of the upper media guide to guide a portion of the force to rotate the media guide 104. The compression member 106 provides force on the media guide 104 to maintain the second portion 130 of the portion 126 in contact with the portion 124 of the brace 102. The portions 130 and 124 work together to restrict rotation from the compression member force and allow rotation in a direction towards the media path until another further force is applied, such as by media 150 contacting the media guide 104. For example, the paper force can drag the media guide 104 toward the feed shaft 154 and away from the hinged position and/or slight upward force counteracted by the force supplied via the compression member 106. A feature of the media guide may assist in proper guidance when force from the media placed on the media guide. For example, the leg 132 may prevent the media guide 104 from sliding towards the feed shaft 154. The center of the protrusion 112 may be lower than the hinge feature 118 of the upper media guide to allow the compression force that generates rotation away from the structural support assembly and a magnitude of a vertical component of the force (e.g., the component perpendicular to the media feed direction) is less than a magnitude of a horizontal component of the force (e.g., the component parallel to the media direction).

The lower media guide 152 and the upper media guide 104 may define a media path that leads to the feed shaft 154 to grab the media 150. A height adjustment mechanism, such as a spring, may be coupled to the lower media guide 152 that is capable of moving the lower media guide 152 vertically with reference to the structural support assembly and change the space of the media path. For example, the height adjustment mechanism may be a spring that lifts the lower guide 152 until the lower guide 152 references against the feed shaft 154. The lower guide 152 may be moved in concert with movement of the media 150 to ensure proper orientation of the media 150.

By utilizing the compact nature of the structural support assembly discussed herein, the vertical footprint of the imaging device 170 may be reduced while providing sufficient guidance by the upper media guide 104.

All of the features disclosed in this specification (including any accompanying claims, abstract and drawings) may be combined in any combination, except combinations where at least some of such features and/or element is are mutually exclusive.

The present description has been shown and described with reference to the foregoing examples, it is understood, however, that other forms, details, and examples may be made without departing from the spirit and scope of the following claims. The use of the words "first," "second," or related terms in the claims are not used to limit the claim elements to an order or location, but are merely used to distinguish separate claim elements.

What is claimed is:

1. A structural support assembly comprising:

a brace comprising:

a structure defining a mount area on a first surface of the brace; and a first protrusion extending from a second surface of the brace;

a media guide comprising:

a blade member;

a hinge member comprising a first portion corresponding to the mount area; and a second protrusion extending away from the hinge member; and a compression member coupled to the first protrusion of the brace and the second protrusion of the media guide to place force on the media guide, the force definable by a vector having a first component magnitude in a first direction towards the mount area that is greater than a second component magnitude in a second direction away from the mount area.

2. The structural support assembly of claim 1, wherein:

the brace further comprises a first portion extending from the mount area substantially parallel to the first surface of the brace; and the media guide further comprises a second portion to limit rotation of the hinge member in a first direction, wherein:

the second surface of the brace is substantially perpendicular to the first surface;

the second protrusion extends in a substantially perpendicular direction to an axis of rotation of the hinge member; and the second portion extends substantially towards the second protrusion of the media guide.

3. The structural support assembly of claim 2, wherein the second portion of the media guide further comprises:

an indented surface capable of receiving the first portion of the brace; and a catch on an end of the second portion, the catch to contact the first portion of the brace when the media guide is in a first orientation.

4. The structural support assembly of claim 1, wherein the media guide further comprises:

a third protrusion extending from the blade member corresponding to the second surface of the brace.

5. The structural support assembly of claim 1, wherein the blade member of the media guide further comprises:

a first surface facing away from the brace; and a second surface opposite the first surface to limit rotation of the media guide when in contact with the second surface of the brace.

6. The structural support assembly of claim 5, wherein the blade member of the media guide further comprises:

a third surface coupled to the first surface at a slope different than the first surface, the third surface facing away from the brace, wherein the first surface and the third surface are substantially flat to guide media.

7. The structural support assembly of claim 1, wherein the media guide further comprises:

a first plurality of skis coupled to an end of the blade member; and a second plurality of skis corresponding to the hinge member.

8. The structural support assembly of claim 1, wherein:

the media guide further comprising a third portion to contact the second surface to limit rotation of the hinge member in a second direction; and the compression member provides force on the media guide to maintain the second portion of the hinge member in contact with the first portion of the brace until another further force is applied by media contacting the media guide, the compression member to be oriented in a position substantially parallel to the first surface of the brace when the media guide is in contact with the brace.

9. The structural support assembly of claim 8, wherein a range of rotation of the media guide defined between a first contact orientation with the brace by the third portion and a second contact orientation with the second portion of the brace is less than 30 degrees.

10. The structural support assembly of claim 1, wherein the compression member is selected from a group consisting of a compression spring, a leaf spring, and a torsion spring.

* * * * *